US007823225B2

(12) United States Patent
Chou

(10) Patent No.: US 7,823,225 B2
(45) Date of Patent: Nov. 2, 2010

(54) BRIDGE FOR SWIMMING GOGGLES

(76) Inventor: Terry Chou, No. 12, Hsin Ho Herng Road, Tainan City (TW)

( * ) Notice: Subject to any disclaimer, the term of this patent is extended or adjusted under 35 U.S.C. 154(b) by 190 days.

(21) Appl. No.: 12/351,844

(22) Filed: Jan. 11, 2009

(65) Prior Publication Data

US 2010/0175174 A1 Jul. 15, 2010

(51) Int. Cl.
*A61F 9/02* (2006.01)

(52) U.S. Cl. ..... 2/446

(58) Field of Classification Search ..... 2/428, 2/430, 445, 446; 351/128, 133
See application file for complete search history.

(56) References Cited

U.S. PATENT DOCUMENTS 5,313,671 A * 5/1994 Flory ..... 2/428
5,390,373 A * 2/1995 Flory ..... 2/430
5,857,221 A * 1/1999 Geneve et al. ..... 2/428
5,894,605 A * 4/1999 Chiang ..... 2/428
6,070,272 A * 6/2000 Chiang ..... 2/442
6,112,334 A * 9/2000 Chiang ..... 2/428
6,119,277 A * 9/2000 Chiang ..... 2/428
6,119,279 A * 9/2000 Haslbeck ..... 2/445
6,247,187 B1 * 6/2001 Chiang ..... 2/428
6,349,417 B1 * 2/2002 Chiang ..... 2/428
6,546,565 B2 * 4/2003 Chiang ..... 2/428
6,883,184 B2 * 4/2005 Lee ..... 2/446
7,024,705 B2 * 4/2006 Chiang ..... 2/445
7,200,876 B2 * 4/2007 Chiang ..... 2/445
7,203,973 B2 * 4/2007 Chiang ..... 2/431

* cited by examiner

*Primary Examiner*—Danny Worrell
(74) *Attorney, Agent, or Firm*—Banger Shia

(57) ABSTRACT

A pair of swimming goggles includes two lens assemblies and a bridge mounted between the lens assemblies. An inner side of each lens assembly includes a bridge coupling portion having a longitudinal axis at an acute angle with a central vertical axis of the bridge. The bridge includes two legs and an arcuate section interconnected between upper ends of the legs. The bridge defines a space having increasing widths toward lower ends of the legs coupled with the bridge coupling portions. A spacing between a rear side of the lower end of each leg and a vertical axis extending through a rear side of one of the lens assemblies is smaller than a spacing between a rear side of the arcuate section and the vertical axis. The arcuate section has a rear arcuate face. A spacing from the rear arcuate face to the vertical axis decreases downward.

4 Claims, 12 Drawing Sheets

BRIDGE FOR SWIMMING GOGGLES

BACKGROUND OF THE INVENTION

1. Field of the Invention

The present invention relates to a bridge for a pair of swimming goggles and, more particularly, to a bridge providing improved wearing comfort, sealing effect, and safety for swimming goggles.

2. Description of the Related Art

FIGS. 7 and 8 show a pair of conventional swimming goggles including two lenses 11', two padding members 12', a bridge 13', and a head strap 14'. Each lens 11' is made of rigid material and includes an inner side having a bridge engaging portion 111' with a through-hole 112' extending in a front/rear direction for coupling with the bridge 13'. Each lens 11' further includes an outer side having a head strap engaging portion 113' for coupling with the head strap 14'. Each padding member 12' is made of soft material and fixed to a rear side of one of the lenses 11'. The bridge 13' is soft and bendable and includes two ends 131' each extending through one of the through-holes 112'. When a wearer wears the pair of swimming goggles of FIGS. 7 and 8, the ends 131' of the bridge 13' facing the face of the wearer are liable to press against and may even injure the wearer the face of the wearer.

FIGS. 9 and 10 illustrate another pair of conventional swimming goggles including a bridge 22' integrally formed with two frames 21' of a soft material. Each frame 21' receives a rigid lens 23'. A padding portion 212' is formed on a rear of each frame 21' behind each lens 23' to improve wearing comfort. Each frame 21' further includes a coupling portion 211' on an outer side thereof for coupling with a head strap 24'. However, when the wearer pulls the head strap 24' outward for adjusting the tightness, the frames 21' and the bridge 22' made of soft material are stretched, such that the spacing between the frames 21' is increased and, thus, can not provide a sealing contact with the eye sockets of the wearer. Furthermore, the stretched bridge 22' presses against the nose of the wearer. This problem can be avoided if the frames 21' and the bridge 22' are made of rigid material. However, the padding members 212' made of the same material as the frames 21' and the bridge 22' would be too hard for the eye sockets.

FIG. 11 shows a further pair of conventional swimming goggles including two soft frames 31', two rigid lenses 32' respectively received in the frames 31', a bridge 33', and a head strap 34'. Each frame 31' includes a padding portion 311' on a rear side thereof. Each frame 31' further includes an inner side having a bridge engaging portion 312' with a through-hole 313' extending in a vertical direction. Each frame 31' further includes an outer side coupled with the head strap 34'. The bridge 33' is in the form of a soft tube having two ends 332' each extending through one of the through-holes 313'. The bridge 33' includes a plurality of positioning protrusions 331' to adjust the spacing between the frames 31'. However, when the wearer pulls the head strap 34' outward for adjusting the tightness, the bridge 33' made of soft material is stretched, such that the spacing between the frames 31' is increased. Furthermore, the stretched bridge 33' presses against two sides of the nose of the wearer.

FIG. 12 shows still another pair of conventional swimming goggles including two frames 41' each receiving a lens 42'. A padding member 43' is formed on a rear side of each frame 41'. Each frame 41' includes an inner side having a bridge engaging portion 411' with a through-hole 412' extending in a front/rear direction of the frame 41'. The bridge 44' is arcuate and includes two ends each having a peg 441' on an inner face thereof, such that each peg 44' of the bridge 44' can extend through one of the through-holes 441'. Such a pair of swimming goggles is disclosed in US Patent Application No. US2008/0010728. However, the ends 442' of pegs 441' extending rearward beyond the rear side of the frames 41' causes uncomfortable feeling to the wearer while the bridge 44' is liable to presses against the nose of the wearer.

BRIEF SUMMARY OF THE INVENTION

A pair of swimming goggles according to the preferred teachings of the present invention includes two lens assemblies each including a front side and a rear side spaced from the front side in a thickness direction. Each lens assembly further includes an inner side and an outer side. The inner sides of the lens assemblies are spaced from each other in a width direction perpendicular to the thickness direction. The inner side of each lens assembly includes a bridge coupling portion having a longitudinal axis and upper and lower ends spaced along the longitudinal axis. A vertical axis extends through the rear side of one of the lens assemblies in a vertical direction perpendicular to the thickness and width directions. A bridge is mounted between the lens assemblies and coupled to the bridge coupling portions. The bridge is made of a rigid, slightly flexible material. The bridge is arcuate and includes a central vertical axis extending in the vertical direction. The longitudinal axis of each bridge coupling portion is at an acute angle with the central vertical axis. The bridge includes two legs each having upper and lower ends. The bridge further includes an arcuate section interconnected between the upper ends of the legs. The bridge defines a space having increasing widths toward the lower ends of the legs. A spacing between a rear side of the lower end of each leg and the vertical axis in the thickness direction is smaller than a spacing between a rear side of the arcuate section and the vertical axis. The arcuate section has a rear arcuate face. A spacing from the rear arcuate face to the vertical axis in the thickness direction decreases downward. The lower end of each leg includes a coupling portion coupled with the bridge coupling portion of one of the two lens assembly. A head strap is coupled to the outer sides of the lens assemblies.

In a preferred form, each lens assembly includes a lens, a coupling frame softer than and mounted to the lens, and a padding member softer than the coupling member and mounted to the lens. The coupling frame of each lens assembly includes an inner side having the bridge coupling portion.

In a preferred form, the bridge coupling portion of each lens assembly includes a hole extending from the upper end through the lower end of the bridge coupling portion along the longitudinal axis. The hole includes a stepped section, forming an upper section and a lower section having a diameter larger than the upper section. The coupling portion of each leg includes a pin having an enlarged distal end with a diameter slightly larger than the diameter of the upper section and smaller than the diameter of the lower section of the hole. The coupling portions of the legs of the bridge are inserted into the holes with each enlarged distal end extending through the upper section into the outer section of one of the holes, and with the enlarged distal ends of the coupling portions engaged with the stepped portions.

The present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

DETAILED DESCRIPTION OF THE INVENTION

Figure 1:
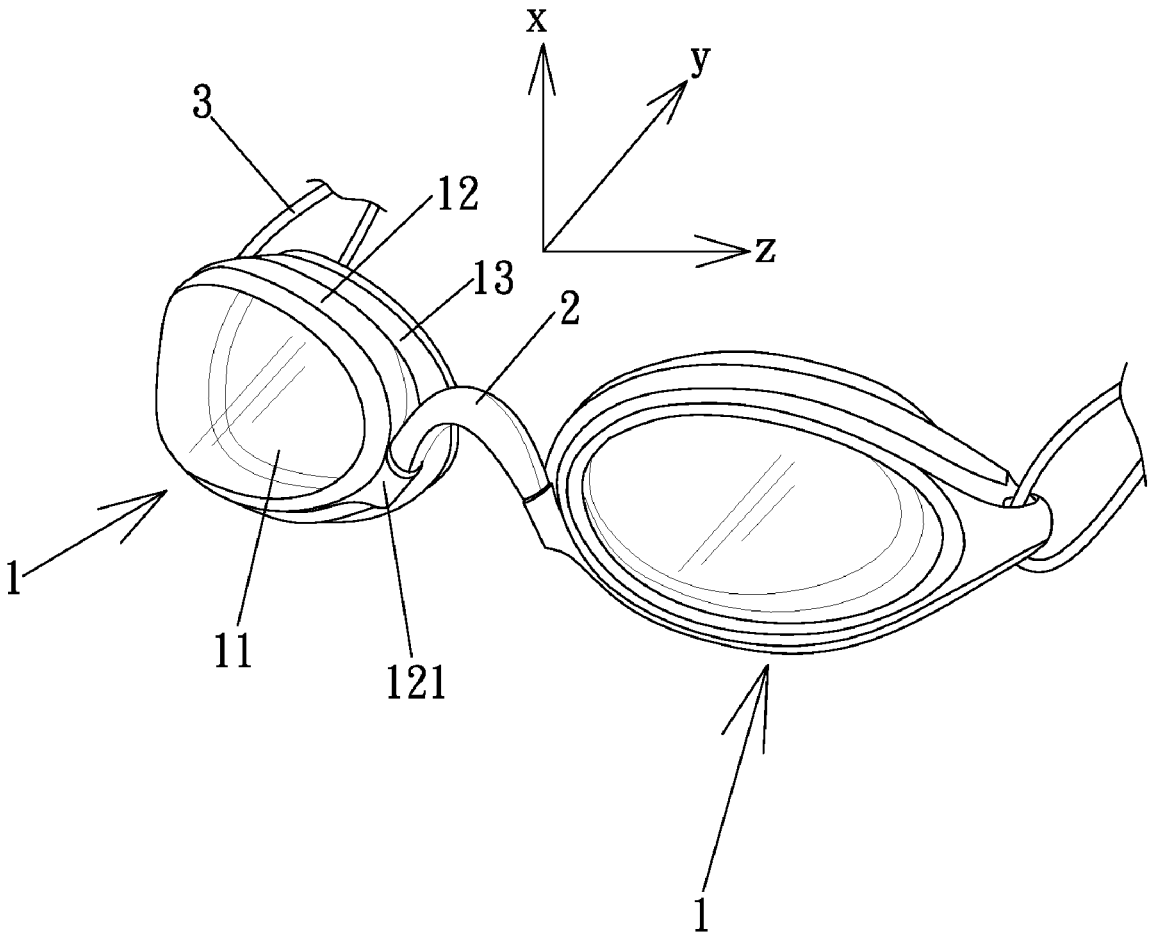
FIG. 1 shows a partial, perspective view of a pair of swimming goggles according to the preferred teachings of the present invention.
Figure 2:
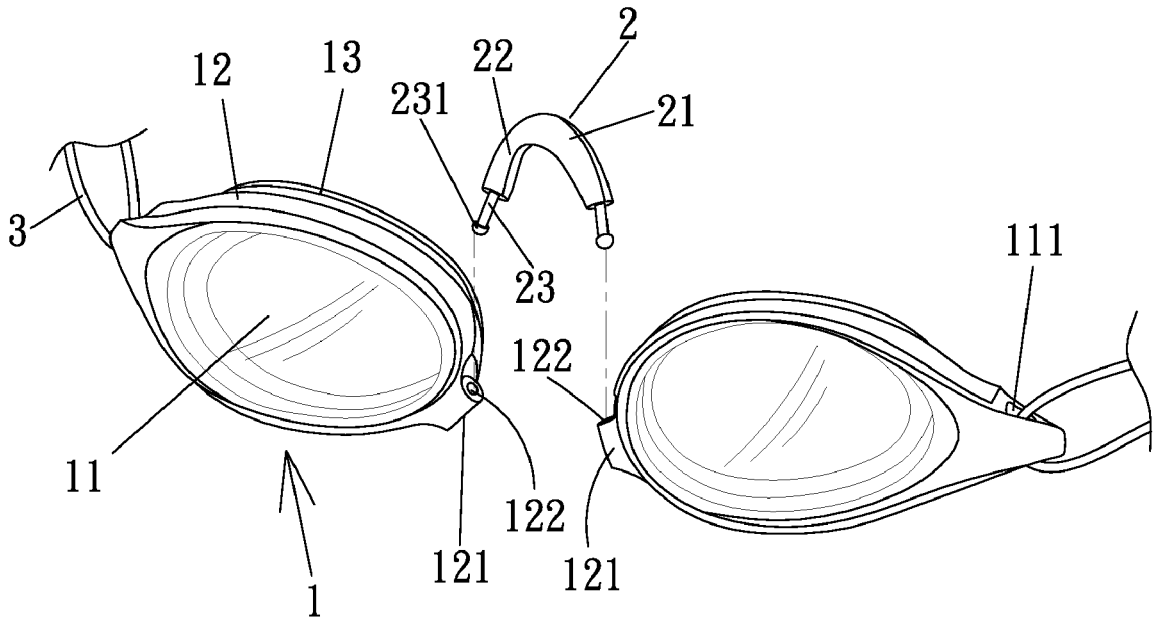
FIG. 2 shows a partial, exploded, perspective view of the pair of swimming goggles of FIG. 1.
Figure 3:
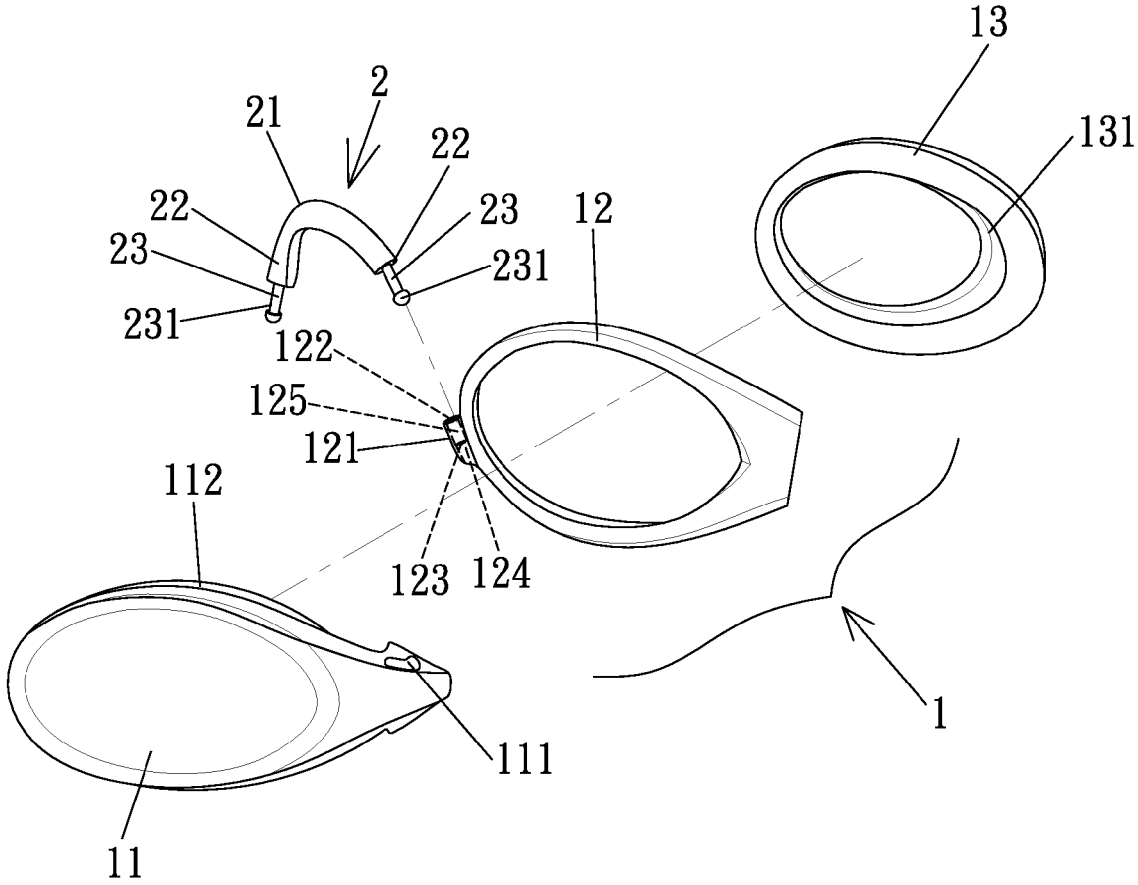
FIG. 3 shows a partial, exploded, perspective view of a bridge and a lens assembly of the pair of swimming goggles of FIG. 1.
Figure 4:
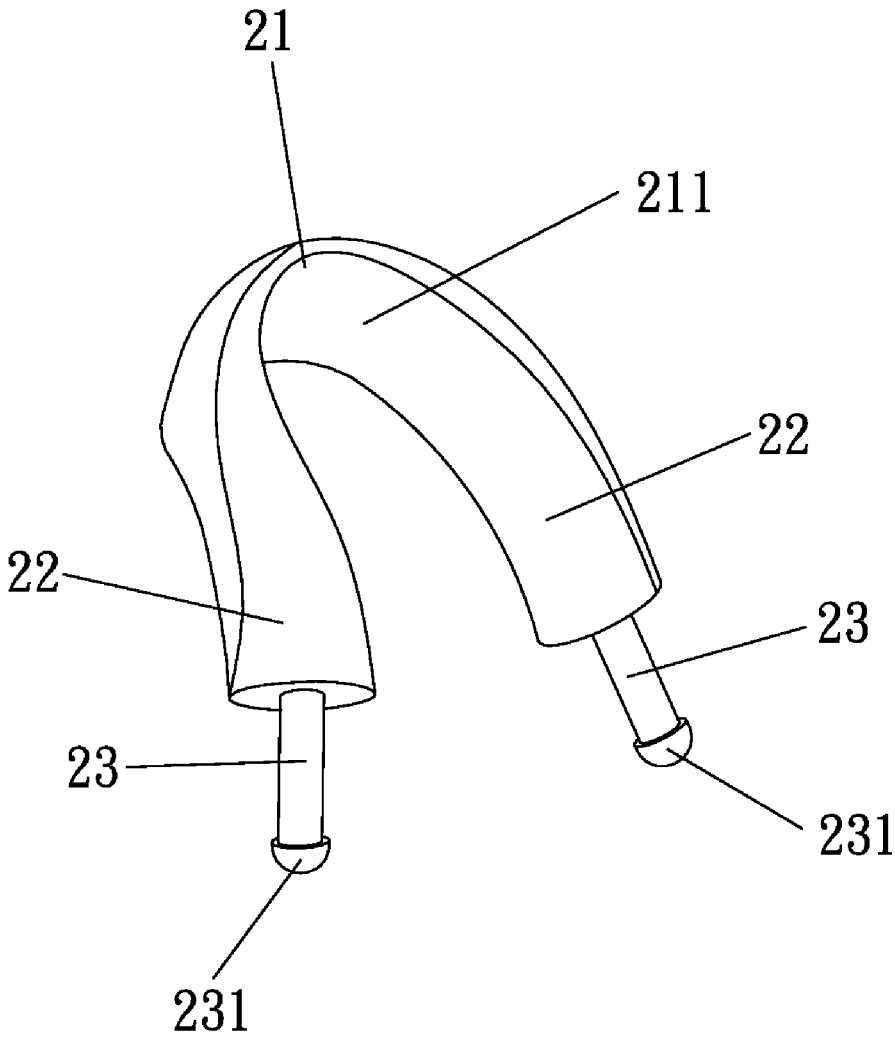
FIG. 4 shows a perspective view of the bridge of the pair of swimming goggles of FIG. 1.
Figure 5:
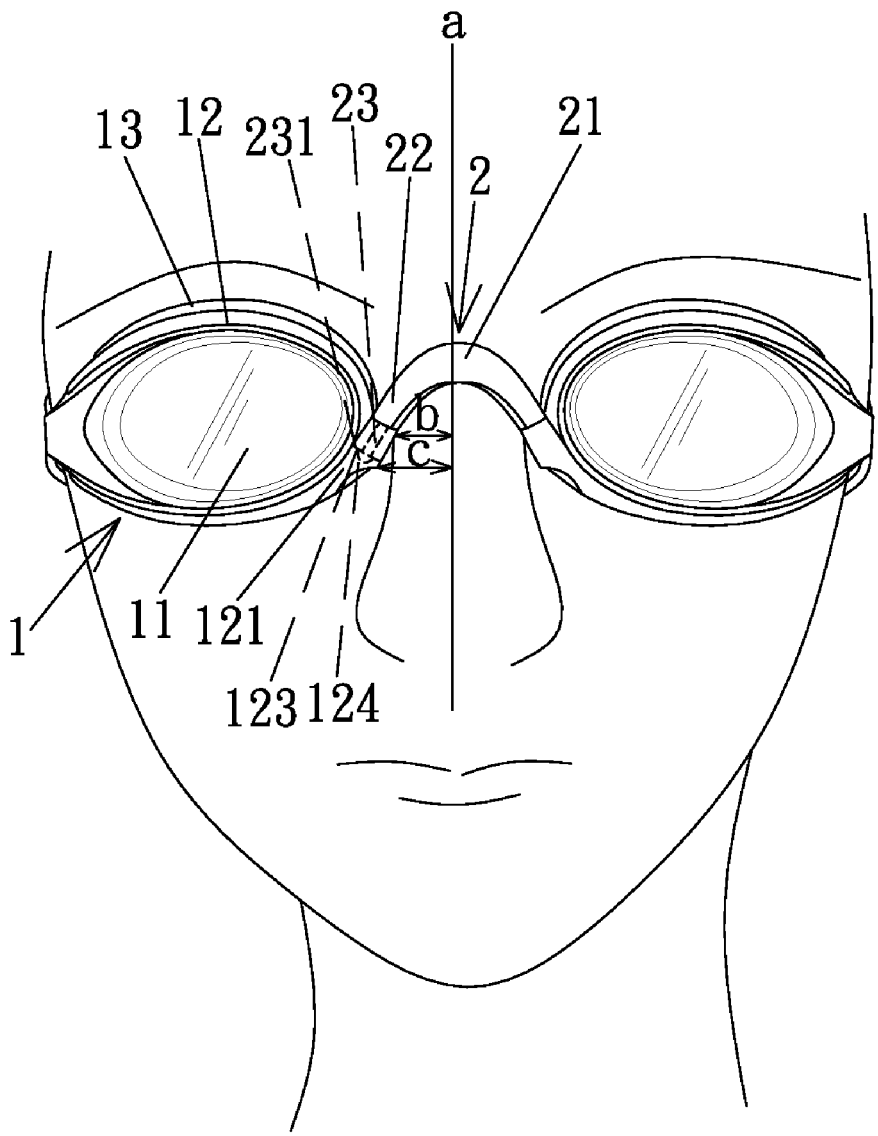
FIG. 5 shows a front view illustrating the pair of swimming goggles of FIG. 1 worn on a face of a wearer.
Figure 6:
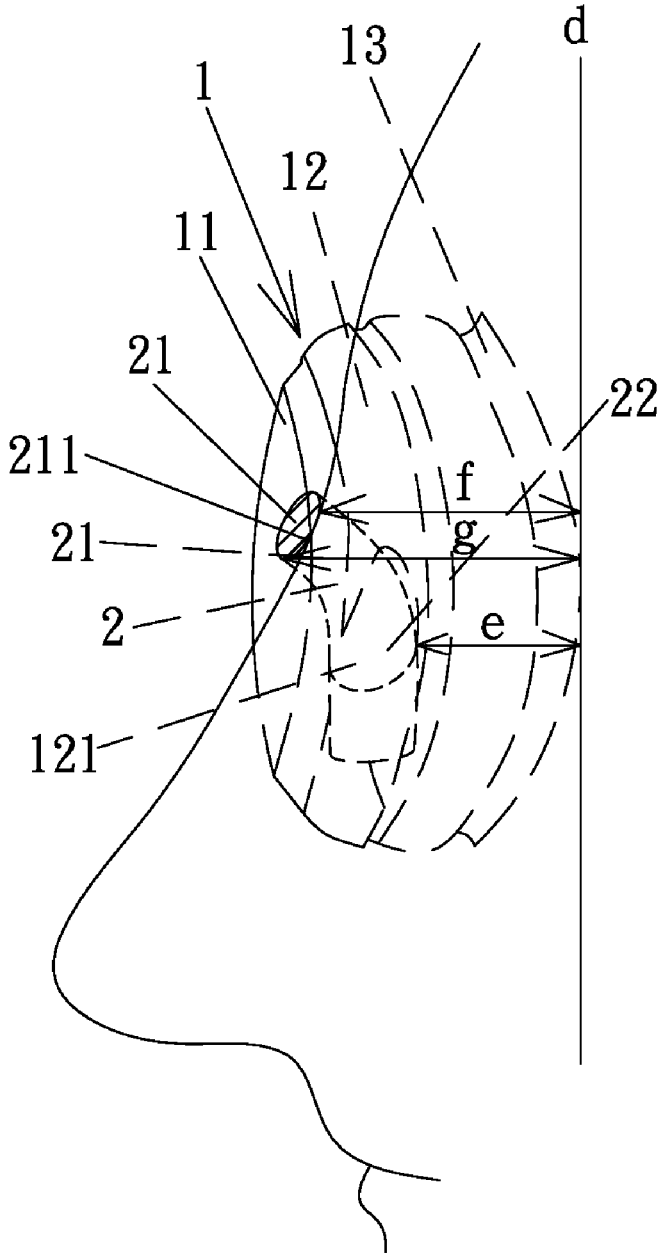
FIG. 6 shows a partial, cross sectional view of the pair of swimming goggles of FIG. 1 worn on the face of the wearer.
Figure 7:
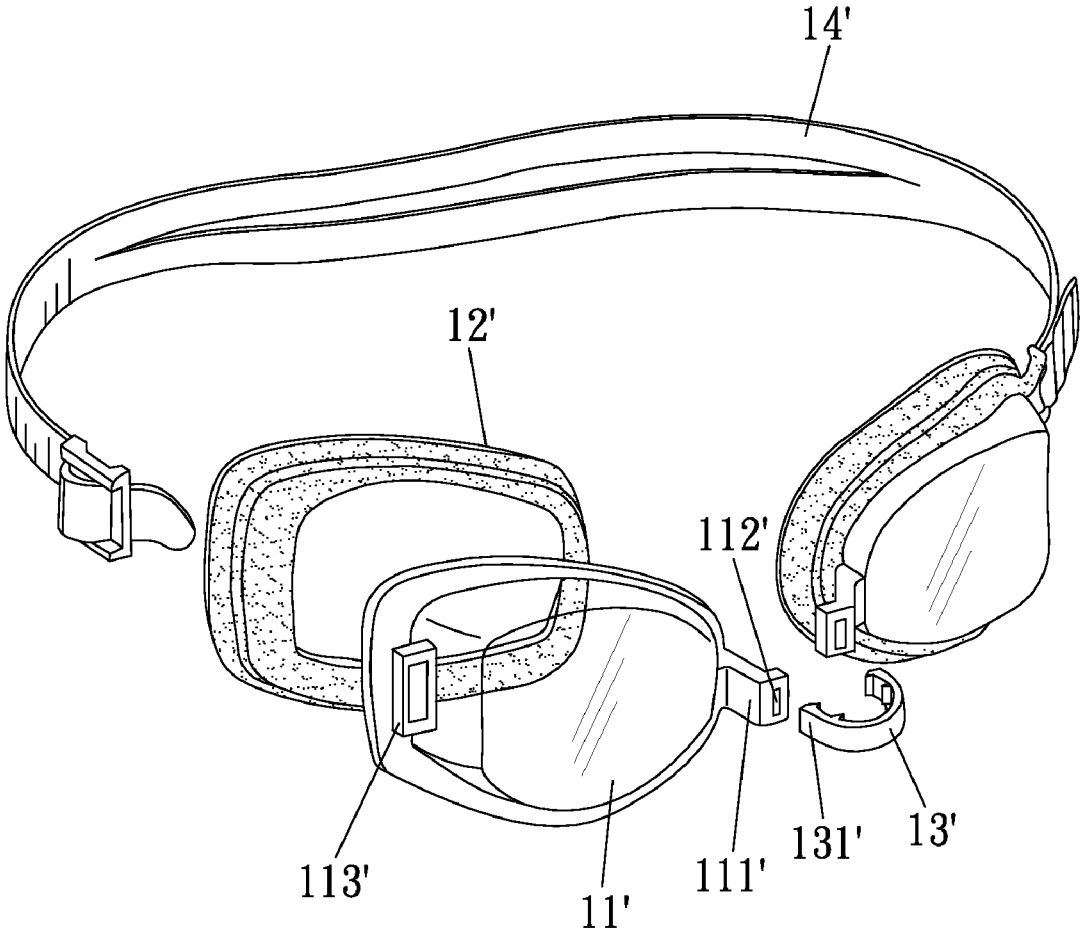
F I G .7 Prior Art
FIG. 7 shows an exploded, perspective view of a pair of conventional swimming goggles.
Figure 8:
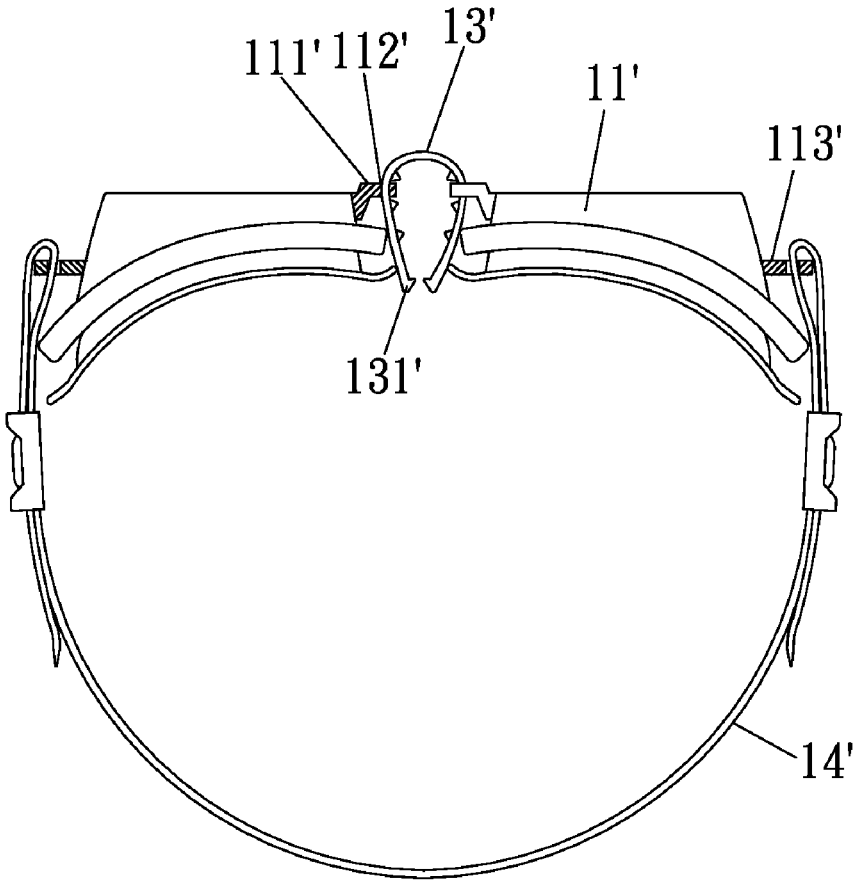
F I G .8 Prior Art
FIG. 8 shows a top view of the pair of swimming goggles of FIG. 7.
Figure 9:
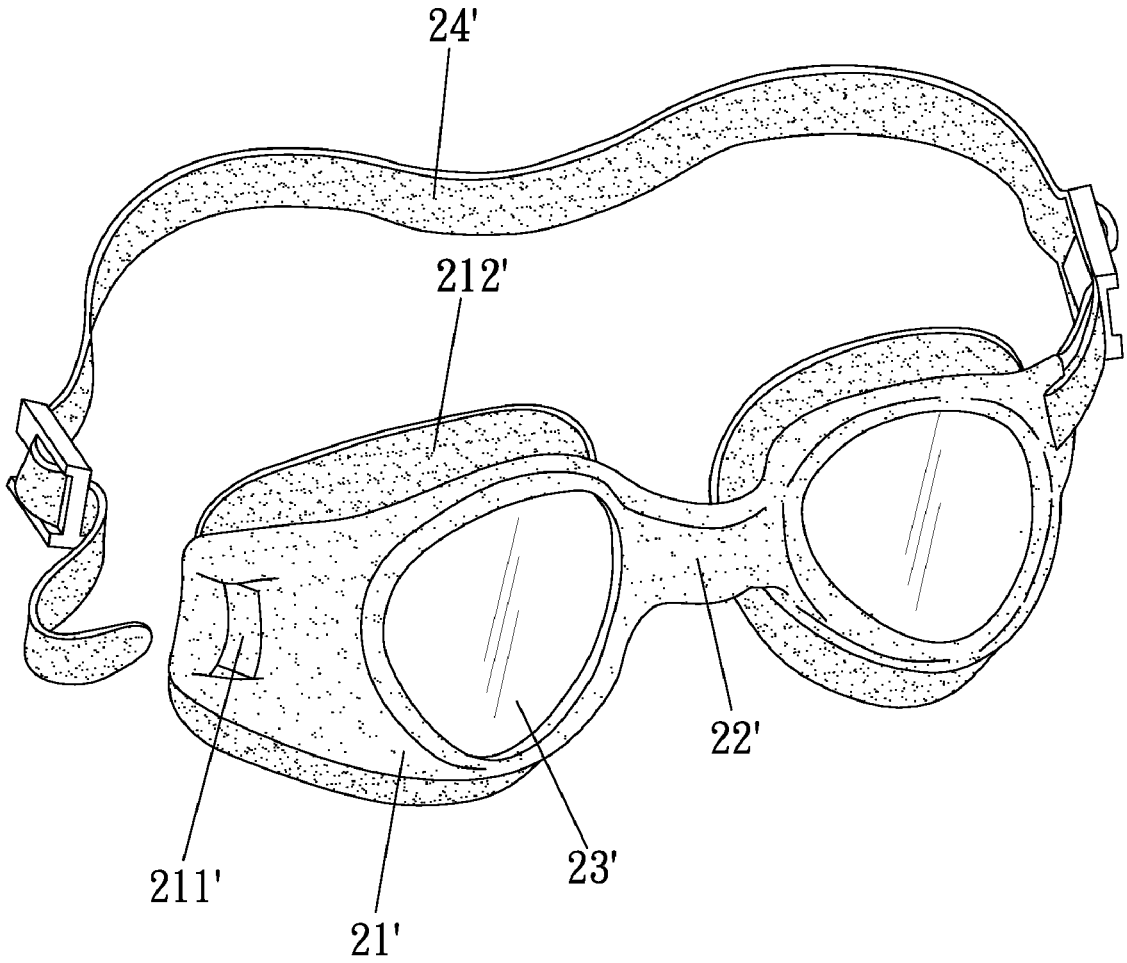
F I G . 9 Prior Art
FIG. 9 shows a perspective view of another pair of conventional swimming goggles.
Figure 10:
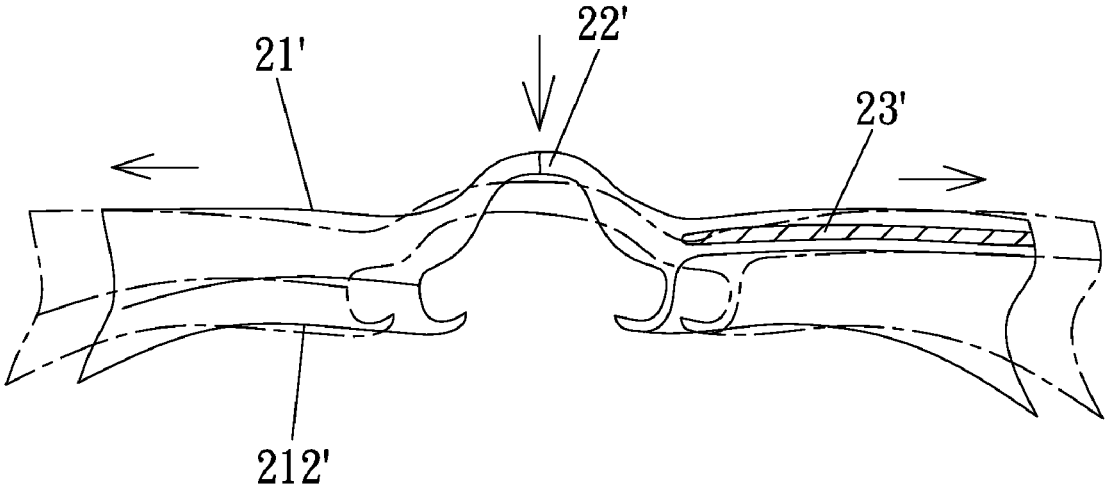
F I G .10 Prior Art
FIG. 10 shows a partial, cross sectional view of the pair of swimming goggles of FIG. 9.
Figure 11:
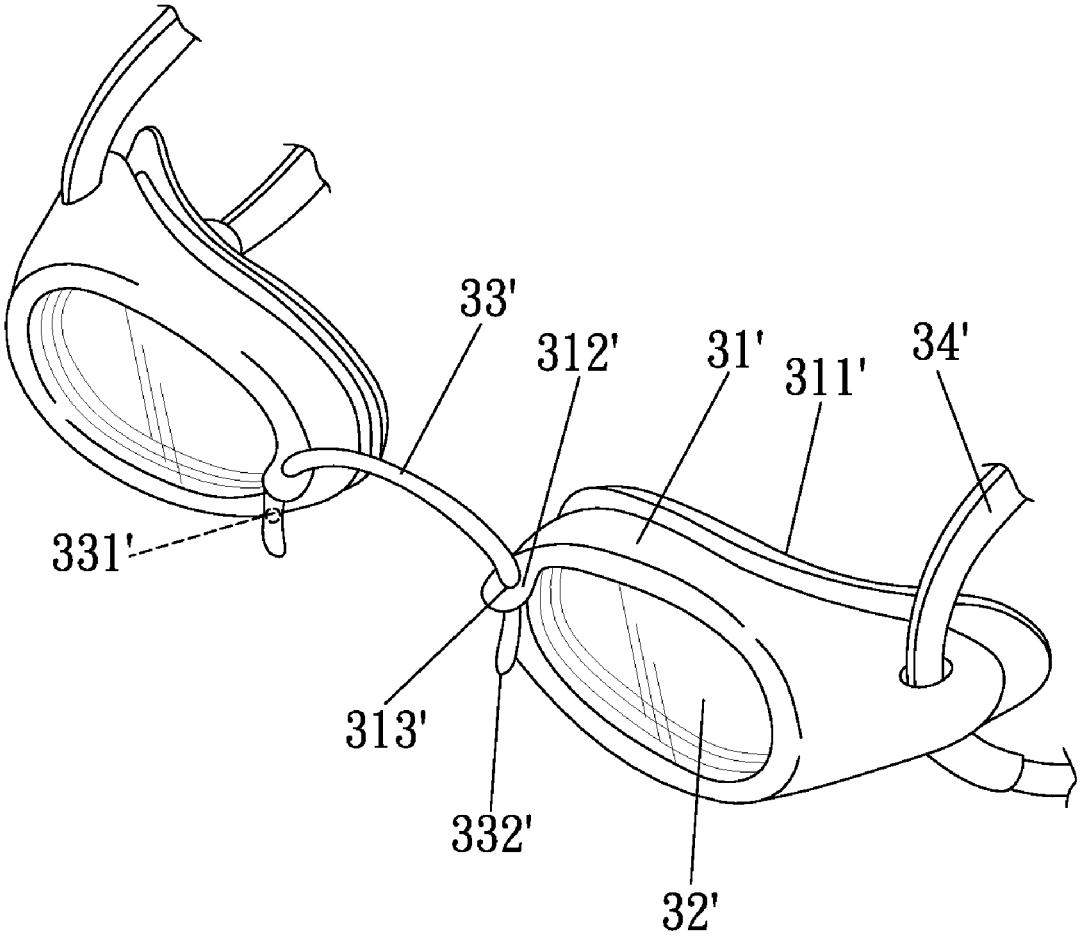
F I G .11 Prior Art
FIG. 11 shows a partial, perspective view of a further pair of conventional swimming goggles.
Figure 12:
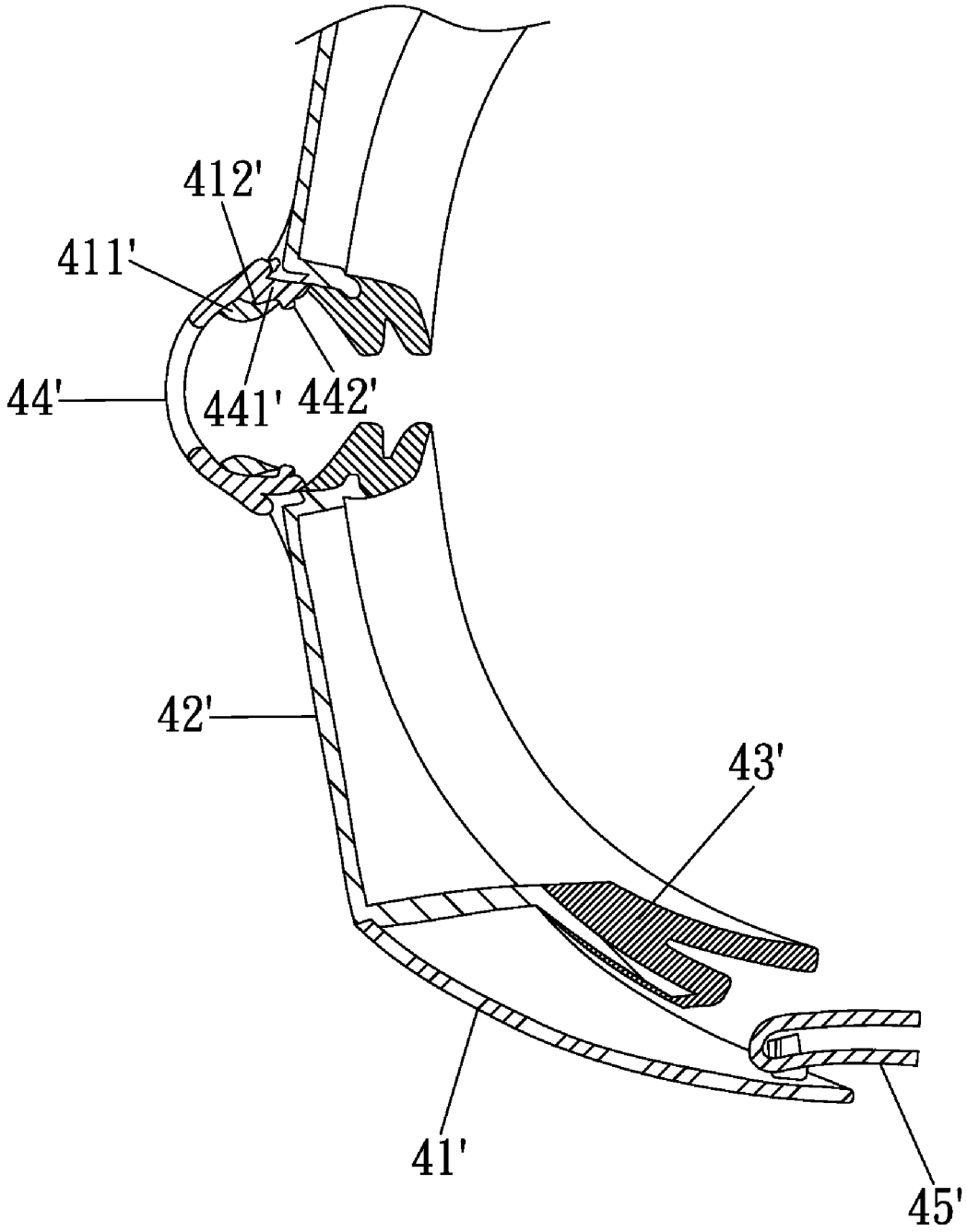
F I G .12 Prior Art
FIG. 12 shows a partial, cross sectional view of still another pair of swimming goggles.

A pair of swimming goggles according to the preferred teachings of the present invention is shown in FIGS. 1-6 of the drawings and generally includes two lens assemblies 1, a bridge 2, and a head strap 3. Each lens assembly 1 includes a lens 11 made of rigid, transparent material, an annular coupling frame 12, and a padding member 13. Each lens 11 includes a front side and a rear side spaced from the front side in a thickness direction y. Each lens 11 further includes an annular wall 112 extending rearward from the rear side. Each lens 11 further includes an outer side with a head strap engaging portion 111 to which the head strap 3 is coupled. The inner sides of the lenses 11 are spaced from each other in a width direction z perpendicular to the thickness direction y. Each coupling frame 12 is mounted around the annular wall 112 of one of the lenses 11 and made of a material so that the coupling frame 12 is slightly stretchable and slightly flexible and has rigidity smaller than that of the lenses 11. Each coupling frame 12 includes an outer periphery having an inner side. A bridge coupling portion in the preferred form shown as a sleeve 121 is formed on the inner side of the outer periphery of each coupling frame 12 and extends along a longitudinal axis at an acute angle with a vertical direction x perpendicular to the thickness and width directions y and z. Each sleeve 121 has an upper end at the center of the inner side of the outer periphery of the coupling frame 12. Each sleeve 121 further includes a lower end spaced from the upper end in the vertical direction x. In the most preferred form shown, each sleeve 121 includes a hole 122 extending from the upper end through the lower end of the sleeve 121 along the longitudinal axis. The hole 122 of each sleeve 121 includes a stepped section 123, forming a smaller, upper section 125 and a larger, lower section 124. Each padding member 13 is made of a material softer than that of coupling frames 12 and includes an annular groove 131 receiving the annular wall 112 of one of the lenses 11. A vertical axis d extends through a rear side of the padding member 13 in the vertical direction x.

The bridge 2 is made of slightly rigid and slightly flexible material and has rigidity smaller than the lenses 11 but larger than the coupling frames 12 and the padding members 13. The bridge 2 is arcuate and includes two legs 22 and an upper, arcuate section 21 interconnected between upper ends of the legs 22 and having a central vertical axis a extending in the vertical direction x. The upper end of each sleeve 121 has a spacing to the central vertical axis a of the bridge 2 smaller than the lower end of the sleeve 121. Furthermore, the bridge 2 defines a space having increasing widths toward lower ends of the legs 21 (see spacing b and spacing c in FIG. 5). A spacing e between a rear side of each leg 22 to the vertical axis d in the thickness direction y is smaller than a spacing f between the rear side of the arcuate section 21 and the vertical axis d. Furthermore, the arcuate section 21 has a rear arcuate face 211. A spacing from the rear arcuate face 211 to the vertical axis d in the thickness direction y decreases downward (see spacing f and spacing g in FIG. 6). The lower end of each leg 22 further includes a bottom face from which a coupling portion 23 in the most preferred form son as a pin with an enlarged distal end 231 extends. The enlarged end 231 has a diameter slightly lager than the diameter of the smaller, upper section 125 and smaller than the diameter of the larger, lower section 124 of the hole 122 of the sleeve 121.

In assembly, coupling portions 23 of the legs 22 of the bridge 2 are inserted into the holes 122 of the sleeves 121 with the enlarged distal end 231 extending through the smaller, upper section 125 into the larger outer section 124 due to flexibility of the coupling frames 12 and resiliency of the bridge 2. The enlarged distal ends 231 of the coupling portions 23 are engaged with the stepped portions 123 of the sleeves 12.

When a wearer wears the pair of swimming goggles according to the preferred teachings of the present invention, the arcuate section 21 is above the nose of the wearer. The wearing comfort at the nose of the wear is improved due to provision of the bridge 2 having the rear arcuate face 211. Furthermore, when the wear wearing pulls the head strap 3 to adjust the tightness, large change in the spacing between the lenses 11 is avoided due to rigidity of the coupling frames 12 and the bridges 2. Furthermore, the padding members 13 can be in intimate contact with the eye sockets of the wearer. Furthermore, since the holes 122 of the lens assemblies 1 and the coupling portions 23 of the bridge 2 extend downwardly away from the central vertical axis a, the lower edge of each side of the nose of the wearer will not be compressed by the pegs 121 and the bridge 2. Wearing comfort is, thus, provided. Furthermore, when the bridge 2 moves due to impact, the bridge 2 is less likely to contact the face of the wear, providing improved safety. Further, the coupling portions 23 of the bridge 2 are completely received in the holes 122 of the sleeves 121 of the coupling frames 12, providing an aesthetically pleasing effect.

The lenses 11, the coupling frames 12, and the padding members 13 are made of materials with different rigidity, such that the coupling frames 12 are softer than the lenses 11, allowing the bridge 2 to be easily inserted into the holes 122 of the sleeves 121 of the coupling frames 12. The coupling frames 12 can be omitted, and the sleeves 121 can be directly formed on the lenses 11.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A pair of swimming goggles comprising:

two lens assemblies each including a front side and a rear side spaced from the front side in a thickness direction, with each of the two lens assemblies further including an inner side and an outer side, with the inner sides of the two lens assemblies spaced from each other in a width direction perpendicular to the thickness direction, with the inner side of each of the two lens assemblies including a bridge coupling portion having a longitudinal axis and upper and lower ends spaced along the longitudinal axis, with a vertical axis extending through the rear side of one of the two lens assemblies in a vertical direction perpendicular to the thickness and width directions;

a bridge mounted between the two lens assemblies and coupled to the bridge coupling portions, with the bridge being made of a rigid, slightly flexible material, with the bridge being arcuate and including a central vertical axis extending in the vertical direction, with the longitudinal axis of each of the bridge coupling portions at an acute angle with the central vertical axis, with the bridge including two legs each having upper and lower ends, with the bridge further including an arcuate section interconnected between the upper ends of the legs, with the bridge defining a space having increasing widths toward the lower ends of the legs, with a spacing between a rear side of the lower end of each of the two legs and the vertical axis in the thickness direction being smaller than a spacing between a rear side of the arcuate section and the vertical axis, with the arcuate section having a rear arcuate face, with a spacing from the rear arcuate face to the vertical axis in the thickness direction decreasing downward, with the lower end of each of the two legs including a coupling portion coupled with the bridge coupling portion of one of the two lens assembly; and a head strap coupled to the outer sides of the two lens assemblies.

2. The pair of swimming goggles as claimed in claim 1, with each of the lens assemblies including a lens, a coupling frame softer than and mounted to the lens, and a padding member softer than the coupling member and mounted to the lens, and with the coupling frame of each of the two lens assemblies including an inner side having the bridge coupling portion.

3. The pair of swimming goggles as claimed in claim 1, with each of the lens assemblies including a lens and a padding member mounted to the lens, and with the lens of each of the two lens assemblies including an inner side having the bridge coupling portion.

4. The pair of swimming goggles as claimed in claim 1, with the bridge coupling portion of each of the lens assemblies including a hole extending from the upper end through the lower end of the bridge coupling portion along the longitudinal axis, with the hole including a stepped section, forming an upper section and a lower section having a diameter larger than the upper section, with the coupling portion of each of the two legs including a pin having an enlarged distal end with a diameter slightly larger than the diameter of the upper section and smaller than the diameter of the lower section of the hole, with the coupling portions of the two legs of the bridge inserted into the holes with each of the enlarged distal ends extending through the upper section into the outer section of one of the holes, and with the enlarged distal ends of the coupling portions engaged with the stepped portions.

* * * * *